United States Patent [19]

Pruss

[11] 4,292,484

[45] Sep. 29, 1981

[54] RESPONSIVE DEVICE FOR A VEHICLE TIRE

[76] Inventor: Günter Pruss, Amselweg 3, 2211 Wrist, Fed. Rep. of Germany

[21] Appl. No.: 32,477

[22] Filed: Apr. 23, 1979

[30] Foreign Application Priority Data

Apr. 25, 1978 [DE] Fed. Rep. of Germany ..... 2818027
Aug. 9, 1978 [DE] Fed. Rep. of Germany ..... 2834808

[51] Int. Cl.[3] ..... H01H 35/24
[52] U.S. Cl. ..... 200/61.25
[58] Field of Search ..... 200/61.22, 61.25, 83 L, 200/83 N, 83 R

[56] References Cited

U.S. PATENT DOCUMENTS

| | | | |
|---|---|---|---|
| 3,222,641 | 12/1965 | Jacobus | 200/61.25 X |
| 3,241,112 | 3/1966 | Linkmeyer | 200/61.25 X |
| 3,845,260 | 10/1974 | Lohr | 200/83 N |
| 3,944,769 | 3/1976 | Wagner | 200/83 N |
| 3,985,984 | 10/1976 | Cappa | 200/61.25 X |
| 4,071,724 | 1/1978 | Lejeune | 200/61.25 |

OTHER PUBLICATIONS

R. J. Sturm, IBM Tech. Disc. Bull., "A Magnetic Floating Elastic Diaphragm Switch", vol. 18, No. 4, Sep. 1975, pp. 1138, 1139.

*Primary Examiner*—James R. Scott
*Attorney, Agent, or Firm*—Spencer & Kaye

[57] ABSTRACT

A device responsive to a pressure loss in a vehicle tire includes a housing held in the vehicle wheel and a sealed chamber supported by the housing and situated in the inner space of the tire. One wall of the chamber is a deformable diaphragm which constitutes a movable contact and which cooperates with a stationary contact arranged in the chamber. The chamber contains gas which is at least at atmospheric pressure. The spring force of the diaphragm, its configuration as well as the pressure in the chamber are coordinated with one another in such a manner that at normal tire pressures the diaphragm is maintained relatively close to the stationary contact, while in case of a drop of the tire pressure below a predetermined value the diaphragm moves away from the stationary contact. The latter has a lead which is accessible externally of the wheel for connection, for example, to a signalling circuit.

14 Claims, 6 Drawing Figures

RESPONSIVE DEVICE FOR A VEHICLE TIRE

BACKGROUND OF THE INVENTION

The invention relates to a device for indicating and transmitting a pressure loss in a pneumatic tire mounted on a motor vehicle.

In order to determine the loss of pressure in a motor vehicle tire, a pulse generator is needed which determines the loss of pressure in the tire and emits a pulse based on this determination. Moreover, a transmission system must transmit this pulse to the driver's area of the motor vehicle and must there be made visible in a display instrument. Such transmission systems are available in technically well executed embodiments. However, what has been lacking up to now is a reliable pulse generator which detects in time the occurrence of a pressure loss and transmits it accurately to the external transmission system.

The prior art switches are unable to perform this function under the difficult environmental conditions at which they have to operate. In particular, it has not been possible to construct a switch which reliably performs its function in the force field or the rotating wheel. Moreover, the differences in heating of the tire and thus of the air within the tire have caused considerable difficulties since temperature compensation has not been feasible heretofore.

SUMMARY OF THE INVENTION

It is an object of the invention to provide an improved device of the above-outlined type that it has a simple structure and can perform reliable service.

This object and others to become apparent as the specification progresses, are accomplished by the invention, according to which, briefly stated, the device has a housing held in the vehicle wheel and a sealed chamber supported by the housing and situated in the inner space of the tire. One wall of the chamber is a deformable diaphragm which constitutes a movable contact and which cooperates with a stationary contact arranged in the chamber. The chamber contains gas which is at least at atmospheric pressure. The spring force of the diaphragm, its configuration as well as the pressure in the chamber are coordinated with one another in such a manner that at normal tire pressures the diaphragm is maintained relatively close to the stationary contact, while in case of a drop of the tire pressure below a predetermined value the diaphragm moves away from the stationary contact. The latter has a lead which is accessible externally of the wheel for connection, for example, to a signalling circuit.

This device can also be mounted on a conventional inflating valve for tubeless tires.

A considerable portion of this device extends into the interior of the tire and is therefore heated in the same manner as the air present in the tire. Thus, the temperature of the air in the interior of the device is caused to follow the temperature developing in the interior of the tire. In this way, erroneous indications due to differences in temperature development are prevented. The diaphragm has a relatively small mass so that it is influenced to such a slight degree by the field of forces (centrifugal forces) of the rotating wheel that the effect of the pressure difference between the pressures on opposite sides of the diaphragm is by far predominant. Apart from the diaphragm, the device does not contain any other movable parts. It thus performs its function of sensing the drop of the pressure to below a prescribed value and conveying such information to the transmission system substantially independently of the prevailing dynamic forces. The pressure in the tire need not be measured; all that is required is a monitoring of the pressure as to whether or not it falls under a certain given value.

According to a preferred embodiment of the invention, the corrugated diaphragm which is preferably made of stamped metal is constantly pressed against the contact in the pressure chamber by the internal pressure of the tire and thus the circuit to the transmission system is always closed until there is a loss of pressure. With this arrangement, the apparatus can be set very accurately to maintain a certain minimum pressure while changes in pressure above the required minimum pressure, for example, due to temperature fluctuations within the tire, would at most have the result that the diaphragm would be pressed more or less tightly against the contact. A signal is generated only when the diaphragm lifts off the contact as a result of an insufficient pressure in the interior of the tire for pressing the diaphragm against the contact.

DESCRIPTION OF THE PREFERRED EMBODIMENTS

Figure 1:
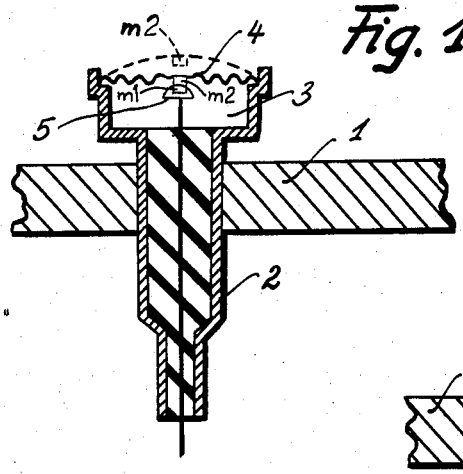
FIGS. 1 and 2 are longitudinal sectional views of a preferred embodiment of the invention, shown in two operational positions.
Figure 2:
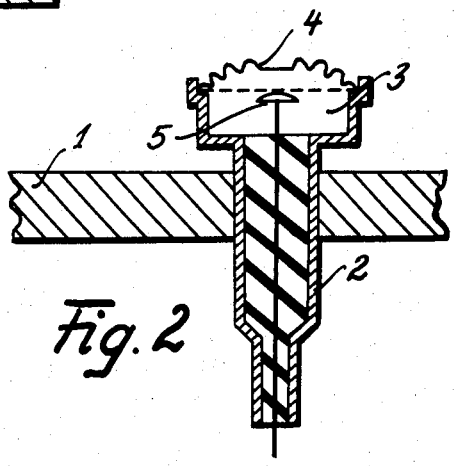
Figure 3:
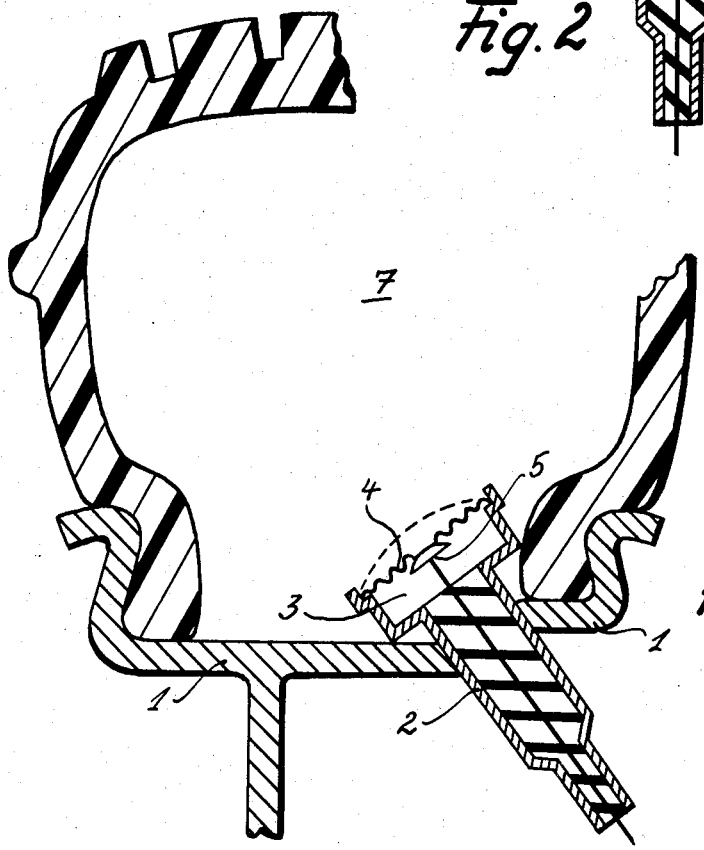
FIG. 3 is a longitudinal sectional view of the first embodiment shown installed in a tire-and-wheel assembly.

Turning to FIGS. 1, 2 and 3, a device according to the invention is fastened in the rim 1 of a vehicle wheel. The device essentially includes a cylindrical housing 2 which is similar to the valve housing of an inflation valve usually employed in motor vehicle tires. A pressure chamber 3 is adjustably screwed onto the housing and is sealed against the interior 7 of the motor vehicle tire in a pressure-tight manner by a circularly stamped, corrugated diaphragm 4 which is preferably of metal. At a certain distance from the corrugated diaphragm 4 within the pressure chamber 3 there is a contact 5 which is insulated from the housing 2. The pressure chamber 3 with the circularly stamped corrugated diaphragm 4, which is thus resilient toward two sides, is disposed in the interior 7 of the tire. The pressure chamber 3 contains air which may be at normal atmospheric pressure encountered during installation, or may be higher. The pressure chamber 3 does not serve to measure the pressure existing in the tire but only to provide temperature follow-up and to stabilize, and provide resiliency for, the corrugated diaphragm 4 (gas pressure spring) when there is a drop in pressure. The housing 2 is fastened to the rim 1 in the same manner as the known valves, perferably diametrally opposite the inflation valve for the tire.

In the embodiment of FIGS. 1 and 2 the device shown is a pressure threshold switch. The diaphragm 4 (ground) is pressed against the insulated contact 5 (which is at + potential) by the pressure in the interior of the tire. The contact 5 is connected, for example, with the coupling circuit (transmitter) of an induction transmission circuit. In the state shown in FIG. 1, the transmission circuit is closed, the tire pressure corresponds to the prescribed value and thus no signalling occurs. In the stage shown in FIG. 2, the diaphragm 4 has moved away from the contact 5 due to a drop in pressure in the tire, the transmission circuit is interrupted and thus a signal is emitted.

In the illustration of FIG. 3, a tire 6 is shown on the rim 1. The device shown in FIGS. 1 and 2 extends into the interior 7 of the tire 6. In order to keep the influence of centrifugal forces on the diaphragm as low as possible, the device according to the invention is inclined, the inner part of the housing 2 extends toward the tire 6.

During manufacture of the rim 1, the device according to the invention is fastened in the manner known for fastening the value body of the inflation valve. After installation of the tire and inflating it to the desired pressure, the diaphragm 4 rests against the insulated contact 5 as shown in solid lines in FIG. 3. If now due to a defect the pressure drops in the interior of the tire, the diaphragm 4 will move away from the contact 5 into its phantom-line position in FIG. 3 due to its own resiliency, possibly with the support of the permissible pressure in the pressure chamber 3; the transmission circuit is interrupted and signalling occurs.

Since the diaphragm 4 is adjustable by means of threads in pressure chamber 3 to set its distance from the positive (t) contact 5, the device, before it is sealed, can be arranged to handle the most varied pressure values. A further advantage can be seen in the fact that any conventional valve body is suitable for the manufacture of the device as described in the present invention.

As shown only in FIG. 1, small magnets m1, m2 of opposite poles may be fastened to the inside of the diaphragm 4 and the contact 5 to accurately define the force needed for the release of the diaphragm from the contact when the pressure drops. It is a matter of course that the passage through the housing 2 is electrically insulated with respect to other conductors and that pressure-tight passages are used. The resilient return force of the diaphragm may possibly also be determined by its thickness.

Figure 4:
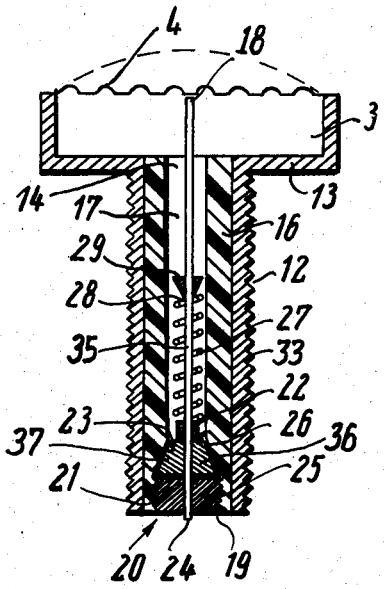
FIG. 4 is a longitudinal sectional view of another preferred embodiment of the invention.
Figure 5:
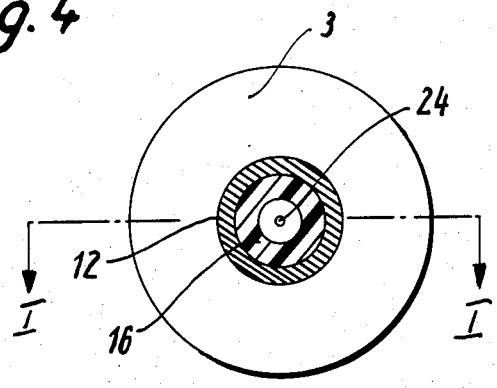
FIG. 5 is a schematic sectional view of the same embodiment taken along line V—V of FIG. 4.
Figure 6:
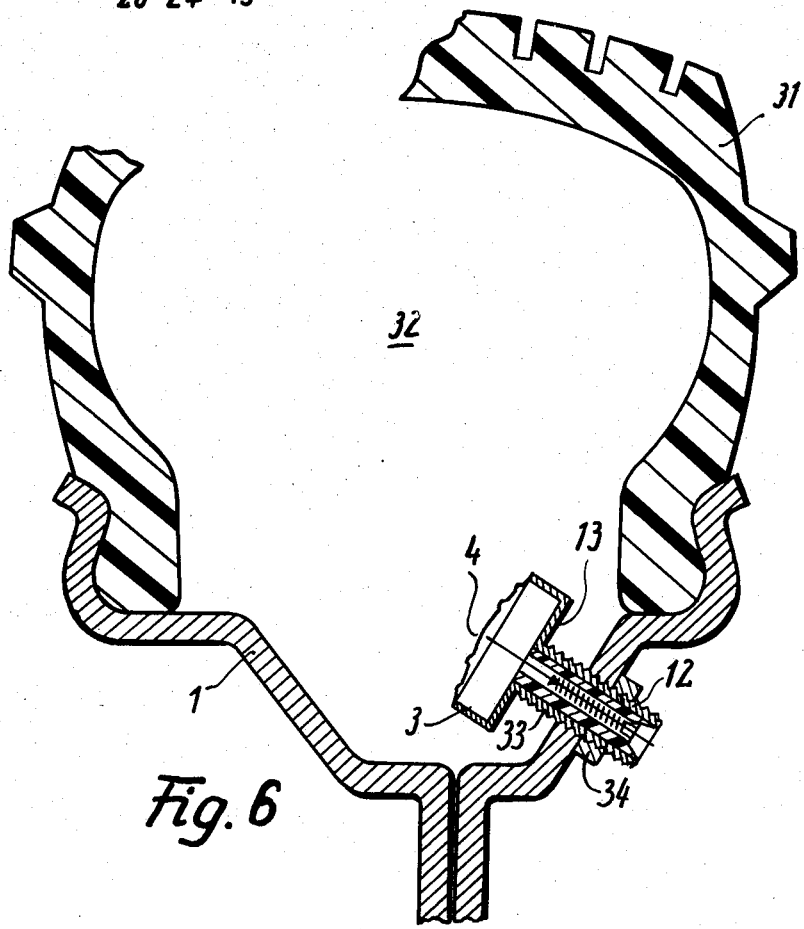
FIG. 6 is a schematic longitudinal sectional view of the same embodiment shown installed in a tire-and-wheel assembly.

Turning now to the embodiment of FIGS. 4, 5 and 6, the pressure chamber 3 is firmly connected with a shaft or sleeve 12. The pressure chamber 3 as well as the shaft 12 are designed as hollow cylinders which are concentrically connected together. For this purpose, the hollow cylinder forming the pressure chamber 3 has a bottom face 13 facing the shaft 12 and provided in its center with a bore 14 which corresponds to the inner diameter of the shaft 12. Opposite the bottom face 13, the pressure chamber 3 is sealed in a pressure-tight manner by diaphragm 4 which is capable of moving in either direction of the longitudinal axis of the shaft.

In the interior of the shaft 12 there is an insulation 16 which is likewise designed as a hollow cylinder. The outer diameter of this hollow cylinder corresponds to the inner diameter of the shaft 12 so that the outer walls of the insulation 16 firmly contact the inner walls of the shaft 12. The fit provided between the insulation and the inner walls of the shaft 12 assures the firm seat of the insulation 16 within the shaft 12. A bore 17 which is provided in the interior of insulation 16 extends concentrically through the insulation 16 and thus through shaft 12. A contact 18 passes through the bore 17 and protrudes, out of the end 19 of shaft 12 facing away from the pressure chamber 3 and contacts the diaphragm 4 when the latter is in the relaxed state It is to be understood that similarly to the embodiment of FIGS. 1–3, small magnets of opposite polarity may be affixed to the diaphragm 4 and the contact 18.

The contact 18 is the upper free end of a needle 35 of a valve insert 20 which is sealingly screwed into the insulation 16 on a sealing face 21 of a frustoconical sealing member 36. This valve insert 20 is designed in the manner of the conventional inflation valves. A valve head 22 is fastened to the valve needle 35 which sealingly cooperates with a valve seat 23 constituted by the top planar face of the sealing member 36. The valve needle 35 is brought through the sealing member 36 in the direction toward the end 19 of shaft 12. On the end piece 24 of the valve needle 35 protruding from end 19 there is displaceably mounted a screw connection 25 with which the frustoconical sealing face 37 of the sealing member 36 is firmly pressed onto a sealing seat 26 formed in the insulation (insulating jacket) 16. The valve head 22 is biased by a compression spring 27 which has at its end 28 facing away from the valve head 22 a tensioning member 29 firmly connected with the valve needle 35.

The device projects in a sealed manner from the interior 32 of a pneumatic tire 31 through the rim 1 to the outside. The device may be sealed with respect to the rim 1 similarly to a conventional inflation valve.

The interior of the device which is sealed against the environment by the valve insert 20 is filled with a gas which when affected by heat behaves essentially like air. Most expediently, air is used to fill the interior space. This air is used to adjust the diaphragm 4. It is of importance to select the air pressure in the interior of the device so that the diaphragm 4, taking into account its inherent deformation forces, is in engagement with the contact 18 when the pneumatic tire 31 has the required air pressure and is lifted away from the contact 18 when the pressure in the pneumatic tire drops.

During installation, the device is pushed with its shaft 12 through a corresponding bore in rim 1 so that the pressure chamber 3 extends into the interior 32 of the pneumatic tire 31. Then the shaft 12 is sealed in a gas-tight manner against the rim 1. After insertion of the valve insert 20, the contact 18 and the diaphragm 4 are supplied with an electrical voltage across the walls of shaft 12 and of pressure chamber 3 so that a current can flow through the circuit formed by the valve insert 20 and the walls as long as the diaphragm 4 engages the contact 18. The diaphragm 4 is connected with the pressure chamber 3 in such a manner that it is capable of being deformed in the direction toward the interior 32 of the pneumatic tire 31 if the pressure drops in the pneumatic tire 31 to thus be lifted away from contact 18. A stabilization of the diaphragm 4 can be effected in that air pressure is generated in the interior of the device. The air pressure in the interior of the device improves temperature follow-up of the gas pressure spring since it assumes the same temperature as the air in the interior 32 of the pneumatic tire 31.

The pressure chamber 3 and the shaft 12 are made of one piece so that they are easy to manufacture and are reliably connected together in a pressure-tight manner.

Expediently, the electrical insulation 16 is made as a cylindrical body described above. Any other insulation of the walls with respect to the valve insert 20 is, however, also possible. The design of the contact 18 as valve insert 20 is advisable for filling the interior of the device with compressed air. It is also possible, however, to utilize only the resiliency of the diaphragm 4 to operate the device. For providing an accurately operating circuit, the diaphragm is designed so that it is capable of performing defined switching movements as a function of the pressure in the interior 32. In particular, a diaphragm design has been found satisfactory in which the diaphragm is provided with concentric annular embossments which permit an essentially parallel diaphragm movement.

The contact 18 may be designed as a valve needle, but it is feasible to bring it out of the device in a different manner. The end of the contact 18 which protrudes from the device is designed as a contact tip onto which a corresponding electrical clip may be placed. In this way, the contact 18 can easily be connected to the electrical transmission unit with the aid of which the changes in pressure in the pneumatic tire 31 can be transmitted to a measuring and indicating device. For example, the transmission of the electrical pulses generated due to the lifting-off of the diaphragm from the contact 18 can be effected by means of induction.

The operation of the device is independent of the design of the valve insert 20. The latter may be designed, for example, as a spring-biased cone valve or as a ball valve which is biased exclusively by the pressure in the interior.

The insulation 16 may be a plastic sleeve. It is advisable to select the plastic so that under the influence of heat it behaves similarly to the shaft 12. The use of a nylon insulation is particularly appropriate.

In principle, the material for the diaphragm 4 may be any elastic material. Metal diaphragms, particularly those of high-grade steel, have been found to be particularly suitable. These diaphragms can be connected in any desired manner with the walls of the pressure chamber. Thus, the diaphragm 4 may be welded to the walls in which case the protective gas welding method is to be preferred. The thickness of the diaphragm 4 depends substantially on its desired elastic properties. With a high air pressure in the interior 32 of the pneumatic tire 31, a thicker diaphragm 4 is selected than for a low air pressure. The embossments of the diaphragm 4 may also be designed as a function of the interior pressure of the pneumatic tire 31.

In order to fasten the device in the rim 1, the outer face of shaft 12 is provided with a thread 33. A fastening nut 34 is screwed onto the thread 33 so as to clamp the bottom face 13 against the rim 1.

The end of contact 18 protruding as a contact tip from the device is simultaneously used to arrest the valve needle for preventing opening of the valve during operation so that the pressure in the interior of the device is maintained. This arrest may be effected by a forked piece which is resiliently inserted into the corresponding cable shoe underneath the head of the valve needle and is supported by the insulation 16 which protrudes from the shaft 12.

It will be understood that the above description of the present application is susceptible to various modification, changes and adaptations, and the same are intended to be comprehended with the meaning and range of equivalents of the appended claims.

I claim:

1. In a device for signalling a pressure loss in the inner space of a tire mounted on a vehicle wheel; said device including mounting means for securing the device to said wheel; housing means defining a chamber projecting into said inner space; a diaphragm secured to said housing means and sealing said chamber from said inner space, whereby opposite faces of the diaphragm are exposed to pressures prevailing in said chamber and in said inner space, respectively; said diaphragm constituting a movable electrical contact; a stationary electric contact supported in said housing; said diaphragm having a first position in which said diaphragm is in electric contact with said stationary contact and a second position in which said diaphragm is electrically separated from said stationary contact; said diaphragm being moved from said first position into said second position when the pressure in said inner space drops below a predetermined value; the improvement comprising a valve means supported in said housing means, said valve means communicating with said chamber and being accessible externally of said wheel for sealing said chamber with respect to ambient atmosphere and for providing for a variability of the pressure in said chamber at will and further wherein said diaphragm is in a relaxed state in said first position and in a stressed state in said second position.

2. A device as defined in claim 1, wherein said diaphragm is high-grade steel and further wherein said diaphragm is welded to said housing means.

3. A device as defined in claim 1, further comprising first and second magnets affixed to said diaphragm and said stationary contact, respectively; said magnets being oriented to one another with opposite polarity,

4. A device as defined in claim 1, wherein said diaphragm has an embossment for rendering the deformation of said diaphragm uniform.

5. A device as defined in claim 1, wherein the heat expansion characteristics of a gas contained in said chamber correspond to those of a gas pressurizing said tire.

6. A device as defined in claim 1, wherein said diaphragm has circular corrugations.

7. A device as defined in claim 6, wherein said corrugations are concentric.

8. A device as defined in claim 1, wherein said valve means comprises a shaft enclosing a passage communicating with said chamber and being accessible externally of said wheel and a valve supported in said shaft for controlling said passage; said valve comprising a valve seat and a movable valve component cooperating with said valve seat; and means for urging said movable valve component against the valve seat into a closed position of said valve.

9. A device as defined in claim 8, wherein said movable valve component includes said stationary contact.

10. A device as defined in claim 9, further comprising an electrically insulating sleeve inserted in said shaft and defining said passage; said movable valve component comprising a valve needle having a free terminus situated in said chamber and constituting said stationary contact.

11. A device as defined in claim 10, wherein said insulating sleeve is nylon.

12. A device as defined in claim 10, further wherein the longitudinal position of said valve needle is adjustable for varying the moment of response of the device as the tire pressure decreases.

13. A device as defined in claim 8, wherein said shaft and said housing means form a single structural unit.

14. A device as defined in claim 13, wherein said shaft passes through said wheel and further wherein said mounting means comprises a thread provided on an outer face of said shaft and a nut threaded on said outer face of said shaft for tightening said structural unit to said wheel.

* * * * *

UNITED STATES PATENT AND TRADEMARK OFFICE

CERTIFICATE OF CORRECTION

PATENT NO. : 4,292,484

DATED : September 29, 1981

INVENTOR(S) : Günter Pruss

It is certified that error appears in the above—identified patent and that said Letters Patent is hereby corrected as shown below:

Column 1, line 24, change "or" to --of-- and line 61, delete "development".

Column 4, line 7, place a period (.) after "state"; line 52, delete "of"; line 62, change "pressure" to --present--

Column 6, line 11, change "electrical" to --electric--.

Change the TITLE of the invention to read:
--PRESSURE LOSS RESPONSIVE DEVICE FOR A VEHICLE TIRE--

Signed and Sealed this

*Twenty-fifth* Day of *May 1982*

[SEAL]

*Attest:*

*Attesting Officer*

GERALD J. MOSSINGHOFF

*Commissioner of Patents and Trademarks*